United States Patent [19]

Saal

[11] Patent Number: 4,996,929

[45] Date of Patent: Mar. 5, 1991

[54] SHELF FRAME CONNECTOR

[76] Inventor: Bruno P. Saal, 28 Allonsius Dr., Etobicoke, Ontario, Canada, M9C 3N5

[21] Appl. No.: 419,257

[22] Filed: Oct. 10, 1989

[51] Int. Cl.[5] ..... A47B 9/00

[52] U.S. Cl. ..... 108/107; 211/187

[58] Field of Search ..... 108/107, 111, 158, 110; 312/107; 211/187, 189, 192, 206, 207

[56] References Cited

U.S. PATENT DOCUMENTS 3,048,245 8/1962 Shewell .
3,102,641 9/1963 Konstant et al. .
3,186,363 6/1965 Moore .
3,217,894 11/1965 Shewell .
4,034,683 7/1977 DiCenzo ..... 108/107
4,549,665 10/1985 Smitley .
4,553,725 11/1985 Vargo .
4,607,576 8/1986 Kranjec ..... 108/107

FOREIGN PATENT DOCUMENTS 0647239 10/1962 Italy ..... 108/107

*Primary Examiner*—Kenneth J. Dorner
*Assistant Examiner*—Gerald A. Anderson
*Attorney, Agent, or Firm*—Kramer, Brufsky & Cifelli

[57] ABSTRACT

A shelf-frame assembly comprising at least four elongate spaced apart corner upright frame members and at least two pair of transverse frame members. There are means for releasably connecting the upright frame members to the transverse frame members comprising a pair of protrusions defining a pair of vertical slots in each upright member and a downward facing tab formed at each end of each transverse frame member.

10 Claims, 4 Drawing Sheets

SHELF FRAME CONNECTOR

BACKGROUND OF THE INVENTION

This invention relates to a shelf-frame assembly and particularly an adjustable, easily assembled, self-supporting shelf-frame assembly.

Shelf-frame assemblies are known and have been used for quite some time. These assemblies are used widely in industrial and commercial settings for storage and warehousing. These units usually include at least four vertical members and a plurality of shelves that are attached to and extend between the vertical members. Alternatively, these units include at least four vertical members and a plurality of horizontal members used to attach the vertical members together and support the shelves. In the prior art, many of the units are assembled with the use of threaded fasteners and thus the assembly process is time consuming and labour intensive. As well, many of the prior art units require braces and/or corner brackets to provide rigidity for the units.

Alternatively, units have been suggested which reduce the need for threaded fasteners. One example is a shelving unit with a shelf clip supported on a vertical member which in turn supports a shelf-flange as shown in U.S. Pat. No. 4,553,725 issued Nov. 19, 1985 to William R. Vargo. Another example is a pair of lugs located on a transverse member which is inserted into a companion pair of apertures on a vertical member as shown in U.S. Pat. No. 4,549,665 issued Oct. 29, 1985 to Bruce B. Smitley.

A particular disadvantage of the unit employing clips is that the clips are relatively small members and are easy to misplace. Further the shelf has to be specially manufactured to connect with the clips. A particular disadvantage of the unit employing lugs is that the lugs and apertures must be manufactured within relatively close tolerances in order that the unit can be properly assembled and thus it would be difficult to manufacture.

The present invention seeks to provide a shelf-frame assembly which can be easily manufactured and easily assembled on site and can be manufactured at a reasonable cost. Further, there is no need to provide braces or corner brackets. As well, special shelves need not be manufactured to connect with the assembly.

SUMMARY OF THE INVENTION

In accordance with one aspect of the invention, there is provided a shelf frame assembly comprising at least four elongate spaced apart corner upright frame members and at least two pair of transverse frame members. There is means for releasably connecting the upright frame members to the transverse frame members comprising a pair of protrusions defining a pair of vertical slots formed in each upright frame member and downwardly facing tabs formed at each end of each transverse member.

In accordance with another aspect of the invention, there is provided a shelf-frame assembly comprising at least four elongate spaced apart corner upright frame members and a shelf. There is means for releasably connecting the shelf to the upright frame members comprising protrusions defining vertical slots formed in each upright frame member and downwardly facing tabs formed at each corner of the shelf.

In accordance with another aspect of the invention, there is provided a frame assembly comprising at least two elongate spaced apart upright frame members and a transverse frame member. There is means for releasably connecting the upright frame members to the transverse frame member comprising a protrusion defining a vertical slot formed in each upright frame member and downwardly facing tabs formed at each end of the transverse member. This aspect of the invention can be used to support one end of a shelf wherein the other end is supported by alternate means. Alternatively, it can be used for supporting equipment.

BRIEF DESCRIPTION OF THE DRAWINGS

The invention is illustrated in particular and preferred embodiments by reference to the accompanying drawings in which.

DETAILED DESCRIPTION OF THE PREFERRED EMBODIMENT

Figure 1:
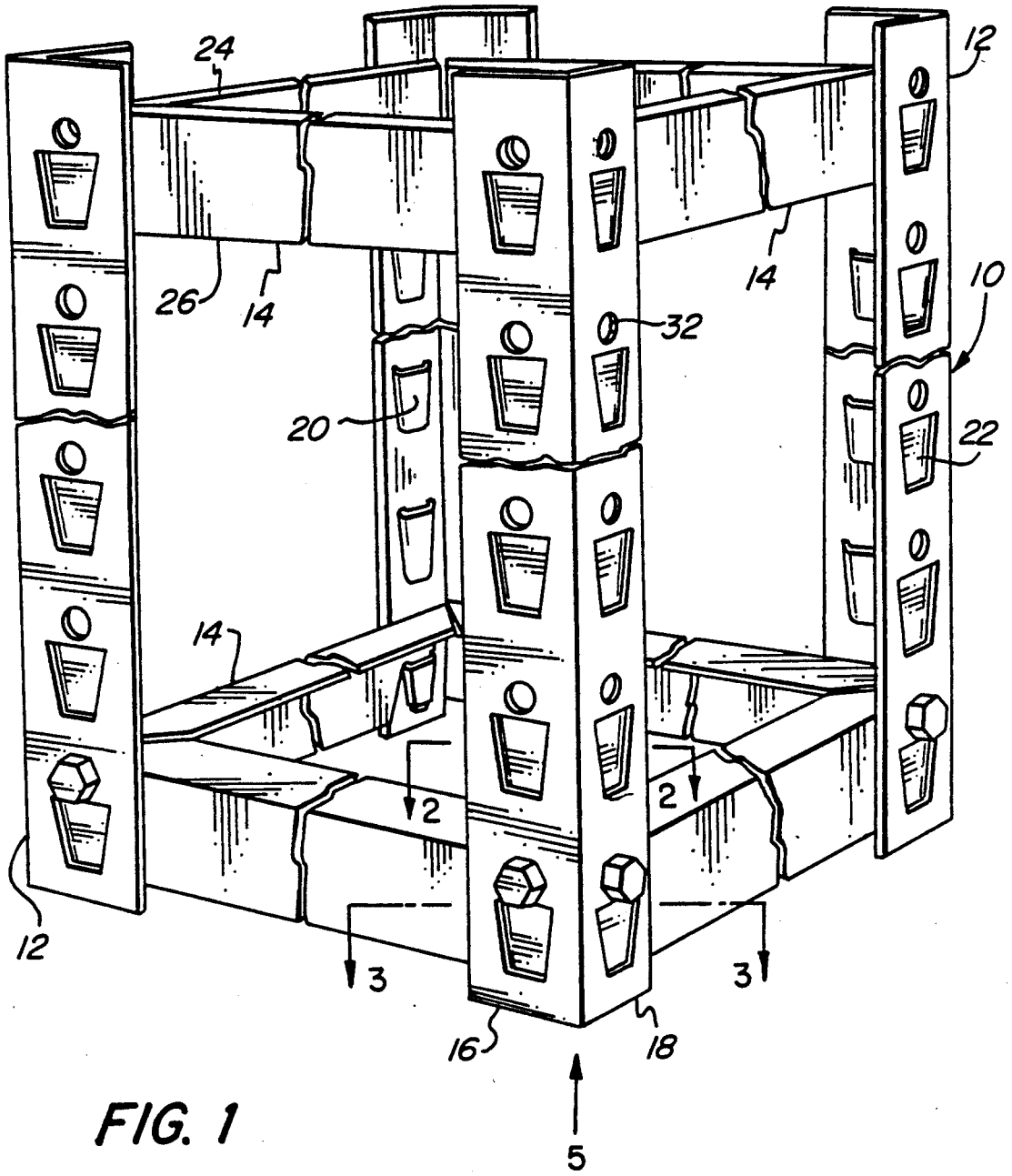
FIG. 1 is a perspective view of a shelf-frame assembly constructed in accordance with one aspect of the present invention.

The shelf-frame assembly as shown in FIG. 1 is adapted to carry a plurality of shelves (not shown). In one 10 embodiment, assembly 10 has at least four, elongate spaced apart upright frame members 12 and at least two pair of transverse frame members 14. As shown in FIG. 1, the upright frame members are positioned at the corners of the assembly.

Figure 4:
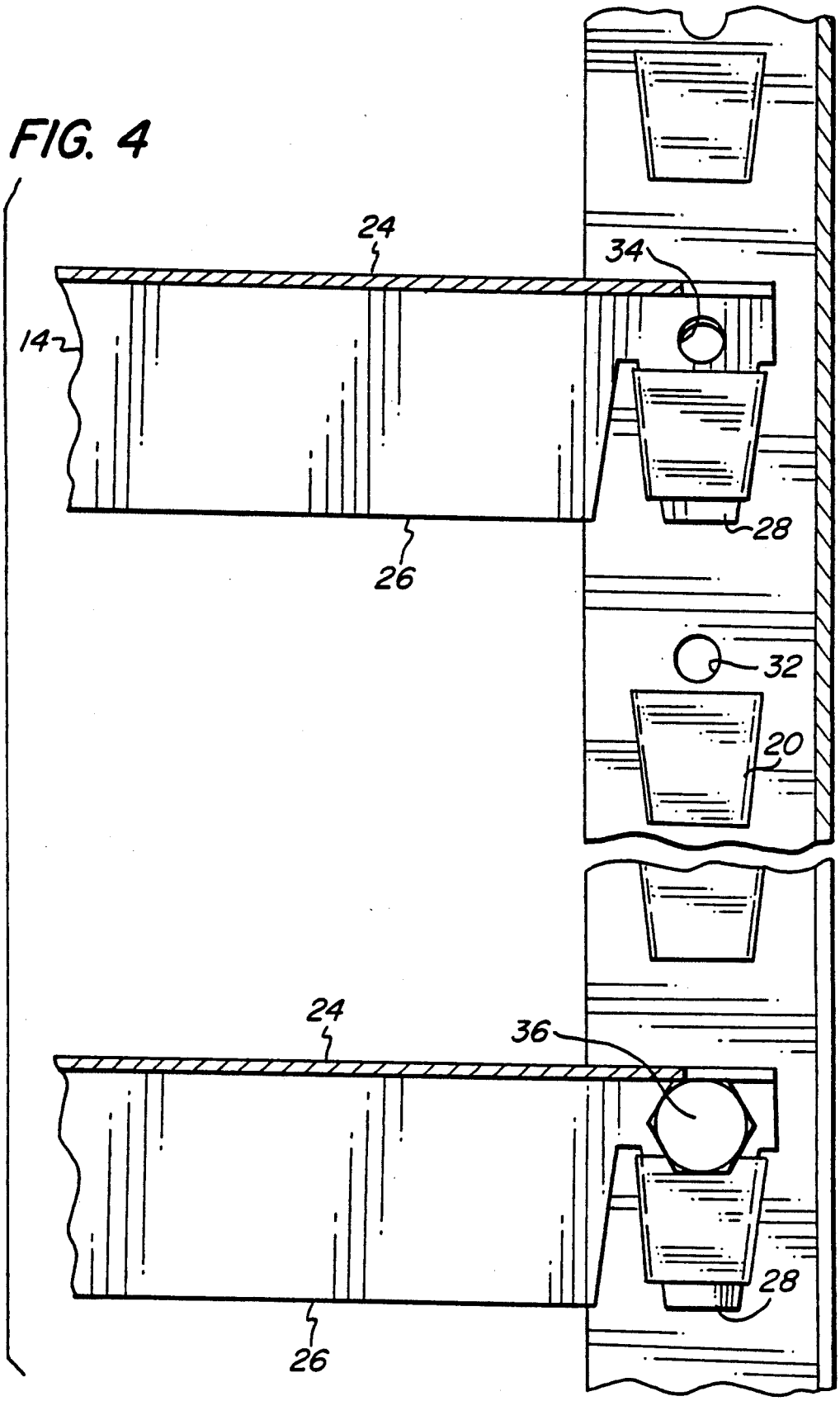
FIG. 4 is a vertical sectional view taken along lines 4—4 of FIG. 3.

Each upright frame member has a first portion 16 and a second portion 18 joined at right angles. A plurality of protrusions 20 are formed in first portion 16 and second portion 18. A slot 22 is formed in protrusion 20. Slot 22 and protrusion 20 are generally bi-laterally symmetrical trapezoids with downwardly decreasing transverse dimensions as can be seen in FIGS. 1 and 4.

Figure 2:
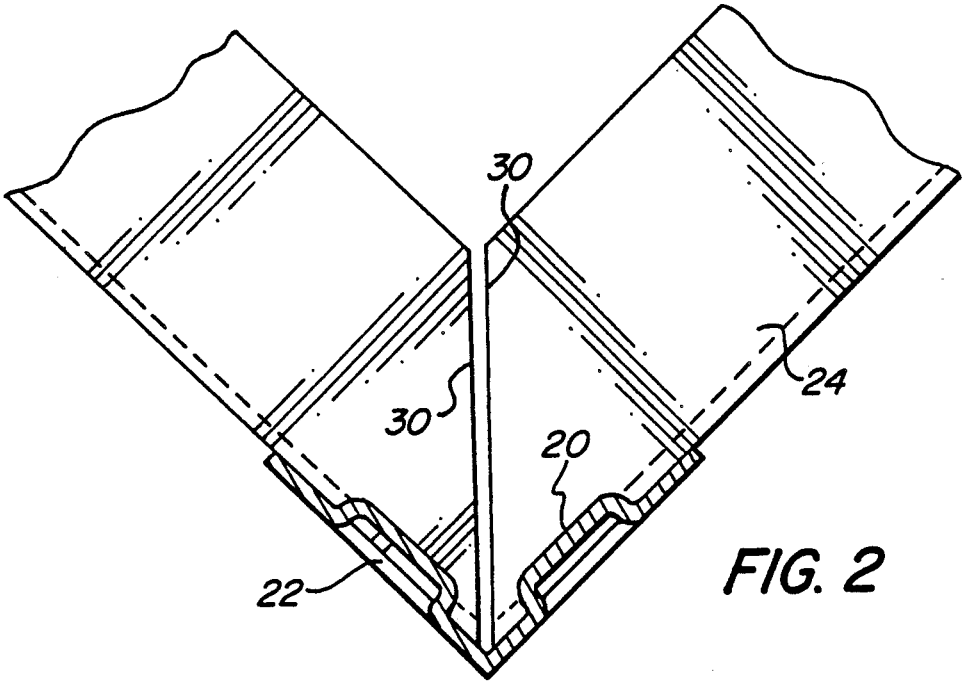
FIG. 2 is a plan view of a portion of the shelf-frame assembly taken along lines 2—2 of FIG. 1.
Figure 3:
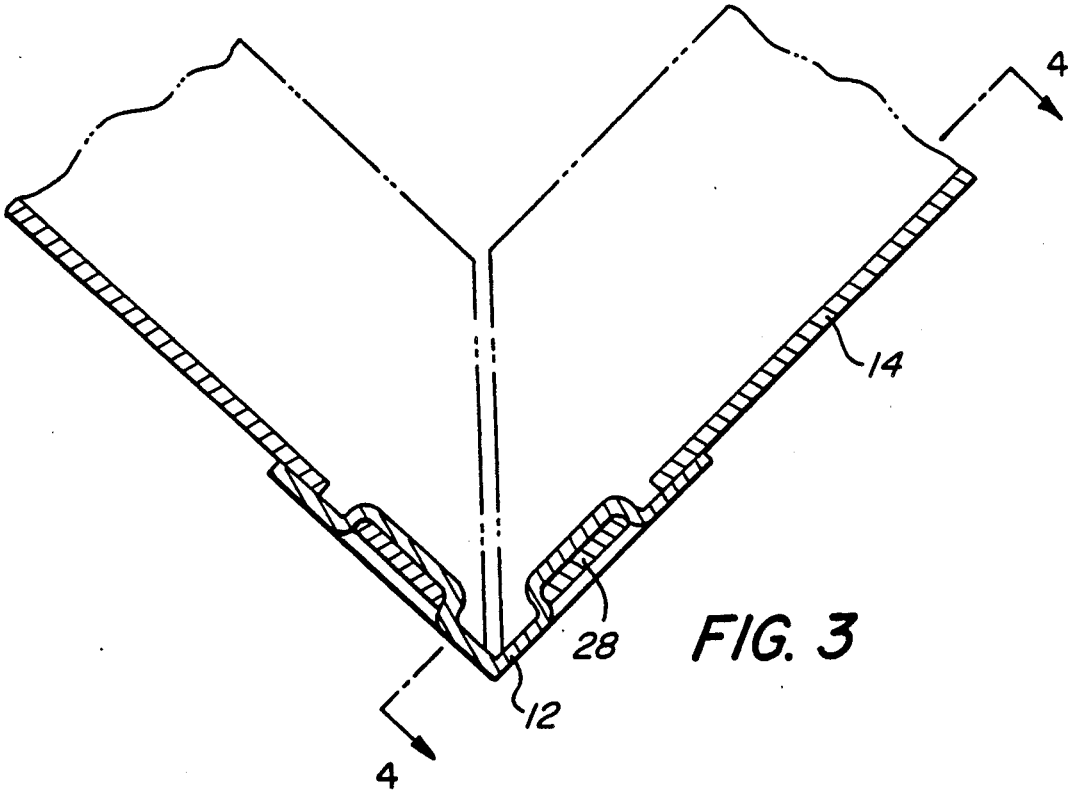
FIG. 3 is a plan view of a portion of shelf-frame assembly taken along lines 3—3 of FIG. 1.
Figure 5:
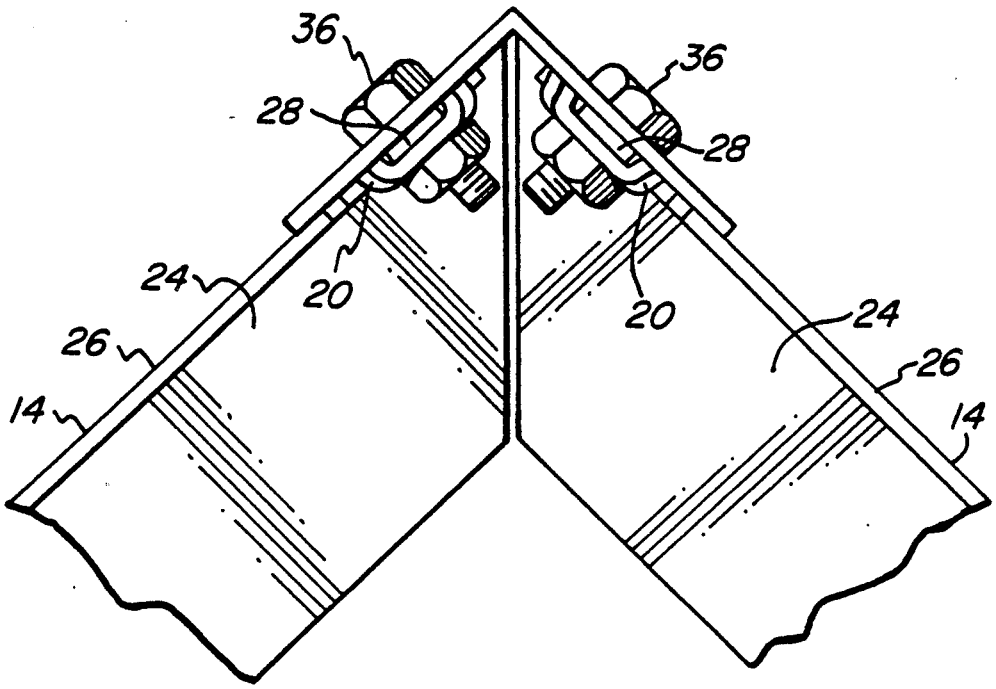
FIG. 5 is a vertical sectional view taken along line 5 of FIG. 1.

Transverse frame member 14 has a horizontal portion 24 joined to a vertical portion 26. A downwardly facing tab 28 is formed in the vertical portion 26. Tab 28 is formed at each end of the transverse frame member 14. Each end 30 of the horizontal portion extend generally at a 45 degree angle to the longitudinal direction of the transverse frame member, such that two adjacent transverse members fit easily together as shown in FIGS. 2, 3 and 5.

An aperture 32 is formed in upright frame member 12 above protrusion 20. A companion aperture 34 is formed in transverse frame member 14 above the tab 28. As shown in FIG. 5, a threaded fastener 36 can be inserted in apertures 32 and 34 to further join the upright frame member to the transverse frame member and provide further support if desired.

The length of the upright frame member 12 and transverse member 14 is a matter of choice. The number of protrusions on each upright member is a matter of choice.

To assemble the shelf-frame assembly 10, four upright frame members 12 are positioned at four corners. A pair of transverse frame members 14 are located at opposite sides of the assembly. Tabs 28 are inserted into slots 22 of the upright frame members. A second pair of transverse frame members 14 are positioned on the remaining opposite sides and the tabs 28 of these frame members 14 are inserted in the appropriate slots 22 of the upright frame member. The number of and location of the transverse frame members used is a matter of choice.

In another embodiment of the invention, two upright frame members 12 and one transverse member 14 can be assembled in the above-mentioned manner. This assembly can be used to support one end of a shelf wherein the other end is supported by alternate means. Alternatively, this assembly can be used to support equipment.

Various modifications and changes to the described shelf-frame assembly will be apparent to those skilled in this art from the preceding description. Accordingly, all such modifications and changes as fall within the scope of the appended claims are intended to be part of this invention.

What is claimed is:

1. A shelf-frame assembly comprising: at least four, elongate, spaced apart corner upright members;

at least two pair of transverse frame members; and means for releasably connecting said upright frame members to said transverse frame members comprising a pair of protrusions forming a pair of vertical slots formed in each upright frame member, downwardly facing tabs insertable into each of the vertical slots formed at each end of each transverse frame member, an aperture formed in each transverse frame member above each tab and an aperture in each upright frame member above each protrusion wherein a threaded fastener is extendible through said apertures in said upright frame members and in said transverse frame members when said members are brought into alignment by insertion of said tab into said slot.

2. A shelf-frame assembly as claimed in claim 1 wherein each upright frame member has a first and second portion joined at right angles and wherein each portion has one of said pair of protrusions.

3. A shelf-frame assembly as claimed in claim 2 wherein each transverse frame member has a horizontal and a vertical portion and wherein said tab is formed in said vertical portion thereof.

4. A shelf-frame assembly as claimed in claim 3 wherein each protrusion and each vertical slot are generally bi-laterally symmetrical trapezoids with downwardly decreasing transverse dimensions and each tab is sized to fit snugly in each vertical slot.

5. A shelf-frame assembly as claimed in claim 4 wherein each end of said horizontal portion of each transverse frame member extends generally at a 45 degree angle to the longitudinal direction of said transverse frame member.

6. A shelf-frame assembly as claimed in claim 5 wherein a plurality of protrusions are formed in each of said upright frame members.

7. A frame assembly comprising:

at least two elongate spaced apart upright frame members;

a transverse frame member; and means for releasably connecting said upright frame members to said transverse frame member comprising a protrusion forming a vertical slot in each upright frame member, a downwardly facing tab insertable into one of the vertical slots formed at each end of said transverse frame member, an aperture formed in each upright frame member above each protrusion, a companion aperture formed in each end of said transverse frame member above each tab and threaded fasteners extendible through aligned apertures in said upright frame members and said transverse member.

8. A frame assembly as claimed in claim 7 wherein said transverse frame member has a horizontal and a vertical portion and wherein said tab is formed in said vertical portion thereof.

9. A frame assembly as claimed in claim 8 wherein each protrusion and each vertical slot are generally bilaterally symmetrical trapezoids With downwardly decreasing transverse dimensions and each tab is sized to fit snugly in each vertical slot.

10. A frame assembly as claimed in claim 9 wherein a plurality of protrusions are formed in each of said upright frame members.

* * * * *